US006250404B1

(12) United States Patent
Gunsaulis

(10) Patent No.: US 6,250,404 B1
(45) Date of Patent: Jun. 26, 2001

(54) DIRECTIONAL BORING HEAD

(75) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 09/328,078

(22) Filed: Jun. 8, 1999

(51) Int. Cl.[7] ..... E21B 10/00
(52) U.S. Cl. ..... 175/62
(58) Field of Search ..... 175/62, 376, 162, 175/161, 73, 397, 398, 400, 410, 394, 415

(56) References Cited

U.S. PATENT DOCUMENTS

| | | | | |
|---|---|---|---|---|
| 0,993,972 | | 5/1911 | English . | |
| 3,760,894 | | 9/1973 | Pitifer | 175/413 |
| 3,999,620 | | 12/1976 | Watson | 175/403 |
| 4,190,128 | | 2/1980 | Emmerich | 175/410 |
| 4,202,419 | * | 5/1980 | Youngblood | 175/374 |
| 4,453,605 | | 6/1984 | Short, Jr. | 175/410 |
| 4,527,931 | * | 7/1985 | Sarin | 175/383 X |
| 4,595,322 | | 6/1986 | Clement | 408/230 |
| 4,603,751 | | 8/1986 | Erickson | 175/410 |
| 4,712,626 | | 12/1987 | Shaw | 175/410 |
| 4,838,366 | | 6/1989 | Jones | 175/410 |
| 5,184,689 | | 2/1993 | Sheirer et al. | 175/420.1 |
| 5,226,489 | | 7/1993 | Woods et al. | 175/420.1 |
| 5,265,989 | | 11/1993 | Stock | 408/227 |
| 5,341,887 | * | 8/1994 | Deken et al. | 175/62 |
| 5,433,281 | | 7/1995 | Black | 175/420.1 |
| 5,458,210 | | 10/1995 | Sollami | 175/420.1 |
| 5,630,478 | | 5/1997 | Schimke | 175/420.1 |
| 5,678,645 | | 10/1997 | Tibbitts et al. | 175/426 |

FOREIGN PATENT DOCUMENTS

| | | |
|---|---|---|
| 0148098 | 7/1950 | (AU) . |
| 0800853 | 12/1950 | (DE) . |
| 0018443 | 8/1913 | (GB) . |
| 0410947 | 5/1934 | (GB) . |
| 0668810 | 3/1952 | (GB) . |

* cited by examiner

*Primary Examiner*—Robert E. Pezzuto
(74) *Attorney, Agent, or Firm*—McKinney & Stringer, P.C.

(57) ABSTRACT

A directional boring head assembly having a directional boring head, with a deflection surface capable of steering the directional boring head, combined with a replaceable cutting member is provided. The position of the cutting member relative to the deflection surface permits the directional boring head to steer the boring machine along the desired path while providing enhanced cutting action adaptable to different soil types. As the boring machine is advanced with rotation, the leading edge of the cutting member contacts only a small portion of the perimeter of the borehole thereby increasing the contact stress between the cutting member and the face of the borehole for more aggressive cutting action in hard ground conditions. Additionally, the directional boring head is provided with a pocket adapted to conform to the cutting member. The pocket engages the cutting member so that the cutting member fits snugly within the directional boring head thereby increasing the stability of the cutting member within the directional boring head. The cutting member may be replaced to simplify maintenance and to accommodate a variety of soil conditions. The directional boring head and the cutting member function together to maximize the cutting and steering capabilities of the directional boring head assembly while maintaining the integrity of the overall structure.

40 Claims, 8 Drawing Sheets

DIRECTIONAL BORING HEAD

FIELD OF THE INVENTION

The present invention relates generally to boring heads, and in particular to directional boring head assemblies for drilling horizontal boreholes underground.

SUMMARY OF THE INVENTION

The present invention is directed to a directional boring head assembly for use with a boring machine capable of directionally drilling horizontal underground boreholes, wherein the boring machine includes a drill string with an end for supporting a directional boring head assembly. The directional boring head assembly comprises a directional boring head and cutting member. The directional boring head has a rear end, a forward portion, and a body portion therebetween. The rear end is releasably connectable to the end of the drill string and the forward portion has a slot therethrough. The cutting member has a planar rear portion, a forward end, and a body portion therebetween. The planar rear portion of the cutting member is insertable into the slot of the directional boring head, and the forward end has a cutting edge. The cutting member is releasably connectable to the directional boring head. The directional boring head is provided with a deflection surface inclined at an angle relative to the longitudinal axis of the directional boring head. A portion of the cutting member extends beyond the forward portion of the directional boring head.

The present invention further includes a directional boring head for use with a boring machine capable of directionally drilling horizontal underground boreholes, wherein the boring machine includes a drill string with an end for supporting a boring head. The directional boring head has a rear end, a forward portion, and a body portion therebetween. The rear end is releasably connectable to the end of the drill string. The forward portion has a slot therethrough adapted to receive a releasable cutting member. The directional boring head is provided with a deflection surface inclined at an angle relative to the longitudinal axis of the directional boring head.

The present invention further includes a directional boring machine capable of directionally drilling horizontal underground boreholes. The directional boring machine comprises a drill string with an end for supporting a directional boring head assembly, means for intermittently rotating and axially advancing the drill string and a directional boring head assembly. The directional boring head assembly comprises a directional boring head and a cutting member releasably connectable to the directional boring head. The directional boring head has a rear end, a forward portion, and a body portion therebetween. The rear end is releasably connectable to the end of the drill string, and the forward portion has slot therethrough. The cutting member has a planar rear portion insertable into the slot of the directional boring head, and a forward end having a cutting edge. The directional boring head is provided with a deflection surface inclined at an angle relative to the longitudinal axis of the directional boring head, and wherein a portion of the cutting member extends beyond the forward portion of the directional boring head.

Finally, the present invention includes a directional boring head assembly for use with a boring machine capable of directionally drilling horizontal underground boreholes, wherein the boring machine includes a drill string with an end for supporting a directional boring head assembly. The directional boring head assembly comprises a directional boring head having a rear end, a forward portion, a body portion therebetween, a forward edge and a single planar cutting blade. The rear end of the directional boring head is releasably connectable to the end of the drill string, and the forward portion defines a deflection surface. The deflection surface is inclined at an angle and terminates at the forward edge. The single planar cutting blade is non-parallel to the longitudinal axis and to the deflection surface of the directional boring head.

BRIEF DESCRIPTION OF THE DRAWINGS

FIG. 6 shows an exploded, perspective view of the directional boring head assembly of FIG. 2.

FIG. 8 is a front end view of the directional boring head assembly of FIG. 2.

FIG. 9 is an alternative embodiment of the directional boring head assembly of the present invention, and shows the cutting member in a position non-perpendicular to the deflection surface of the directional boring head.

DETAILED DESCRIPTION OF THE PREFERRED EMBODIMENTS

Boring machines are used in industry to form boreholes under and around obstacles in the ground. Typically, boring machines are used to form boreholes under roadways to run conduits such as utility lines. Important in the operation of the boring machine is the ability to steer the boring machine along the desired path. The so called "slant-face" technology is often employed to provide boring machines with boring heads capable of steering drilling operations along a desired path by axially advancing the drill string without rotation.

There is a continuing need to develop boring heads capable of operating in a variety of soil conditions. The present invention improves flexibility and stability by providing a replaceable cutting member in combination with a slant faced directional boring head. The cutting member provides a forward edge for enhanced cutting and piercing capabilities, and the deflection surface, sometimes referred to as a directional surface, provides directional control and steering capabilities. The replaceable cutting member adds flexibility to the drilling operation by permitting the operator to change the cutting member as needed for variable soil conditions or maintenance. Additionally, the present invention employs a pocket in the directional boring head for holding the cutting member within the directional boring head. The pocket reduces the likelihood of incidents such as the loosening of bolts, and the need for numerous connecting devices, such as high strength bolts, to secure the replaceable cutting member within the directional boring head. These and other advantages of the present invention will be apparent from the following description of the preferred embodiments.

Figure 1:
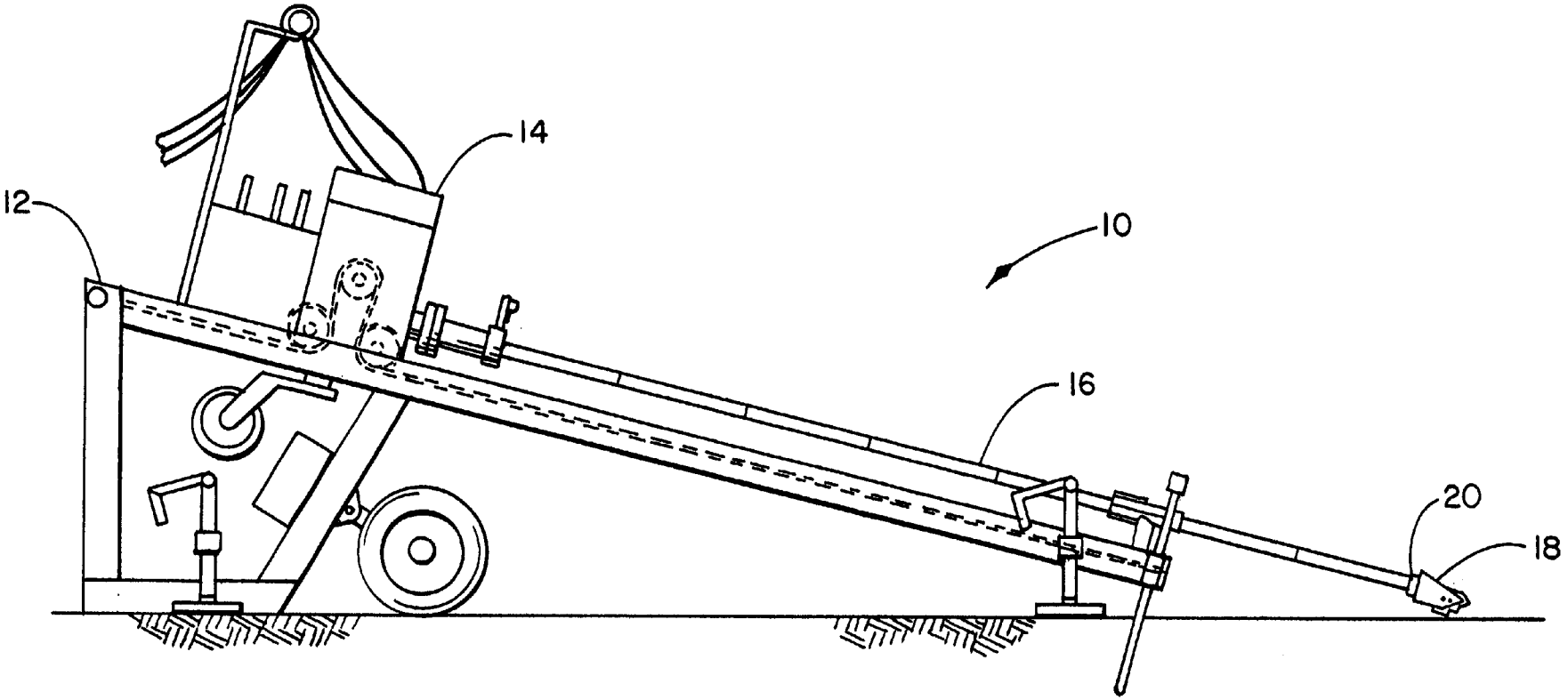
FIG. 1 is a side elevational view of a directional boring machine for drilling a horizontal borehole in the earth.

Turning now to the drawings in general and to FIG. 1 in particular, shown therein is a boring machine 10 constructed in accordance with the present invention. Preferably, the boring machine 10 generally comprises a frame 12, a drive mechanism 14 supported on the frame 12, a drill string 16 and a directional boring head assembly 18. The drive mechanism 14 may be used to intermittently rotate and axially advance the drill string 16. The drill string 16 has an end 20 adapted to support a directional boring head assembly 18, as will be more fully described herein.

While the boring machine in FIG. 1 is depicted as a rotary boring machine for drilling underground boreholes, it will be appreciated that the directional boring head assembly may be used in conjunction with a variety of drilling and boring systems. For example, the directional boring head assembly may be used with percussive, rotary, hydraulic, electric, and manual systems, as well as other types of drilling and boring machines.

Figure 2:
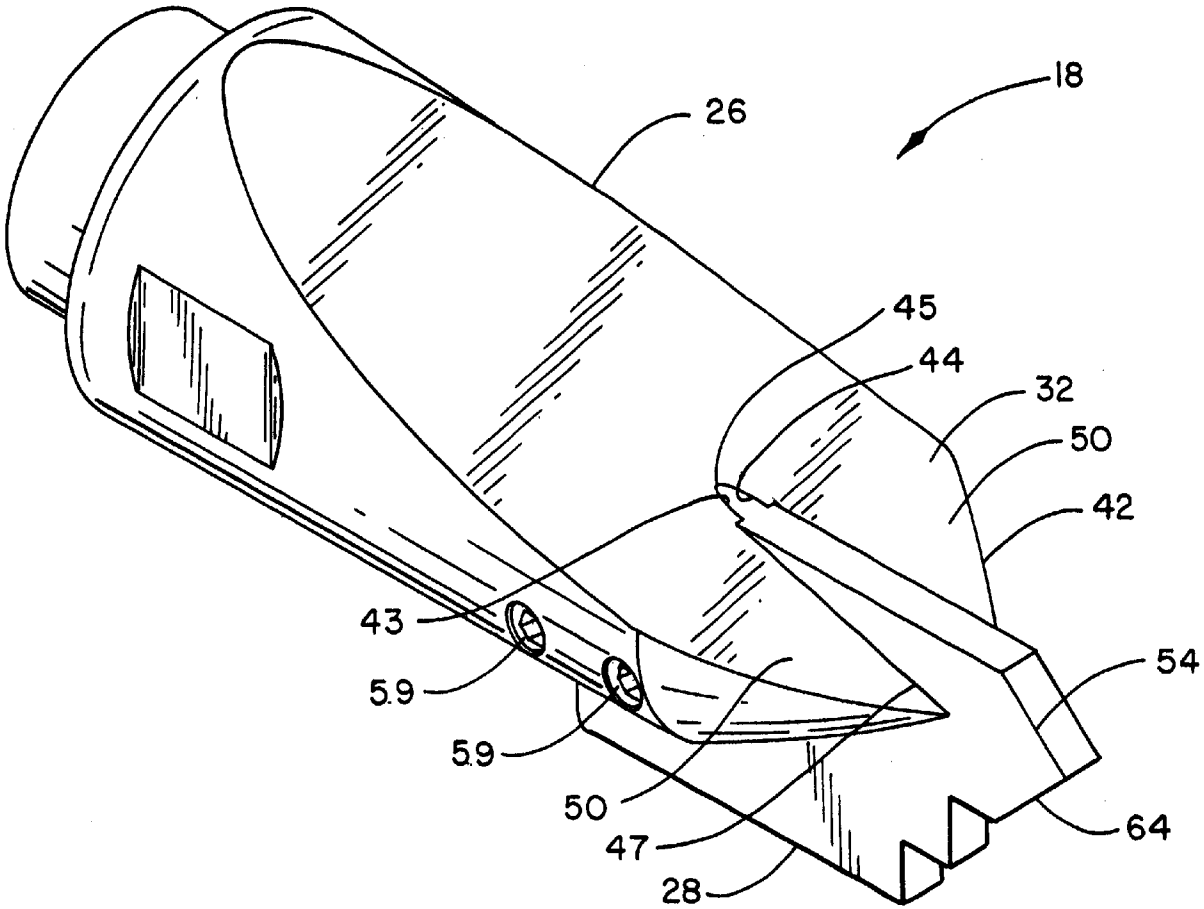
FIG. 2 is an assembled, perspective view of the directional boring head assembly in accordance with the present invention.
Figure 2:
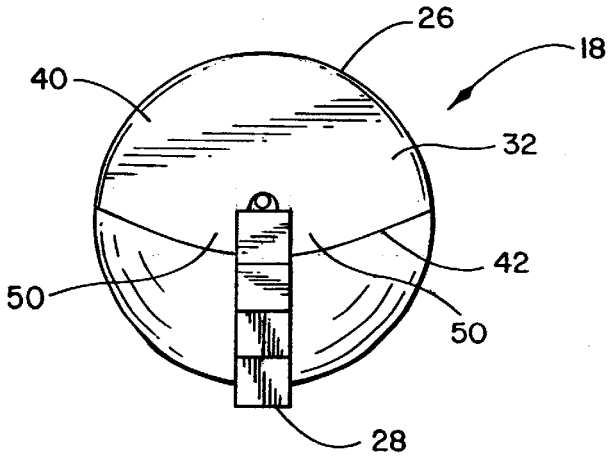

Turning now to FIG. 2, the preferred directional boring head assembly 18 for use with the boring machine 10 is illustrated. The directional boring head assembly 18 generally comprises a directional boring head 26 and a cutting member 28.

Figure 3:
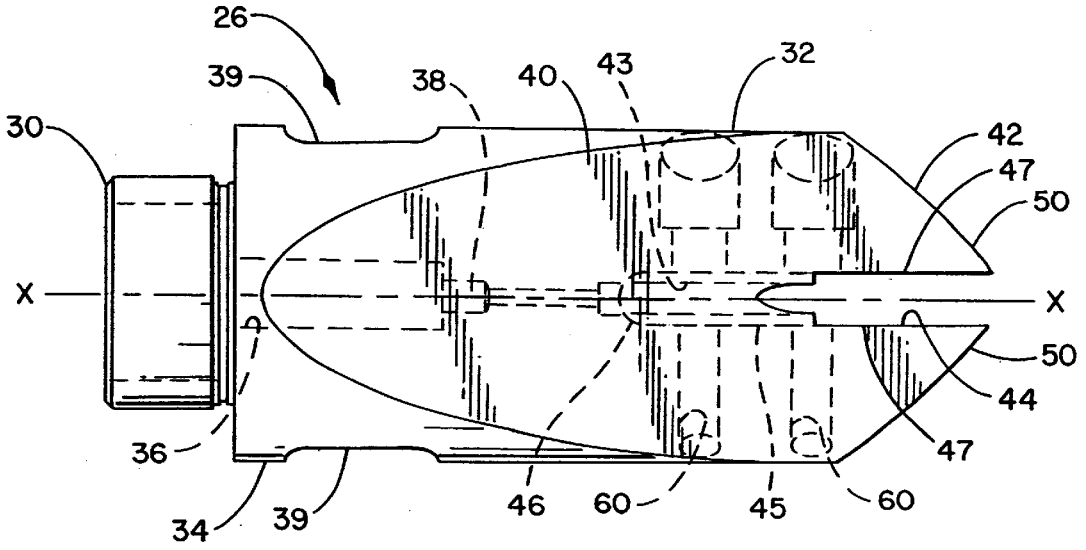
FIG. 3 is a plan view of the directional boring head shown in FIG. 2.
Figure 4:
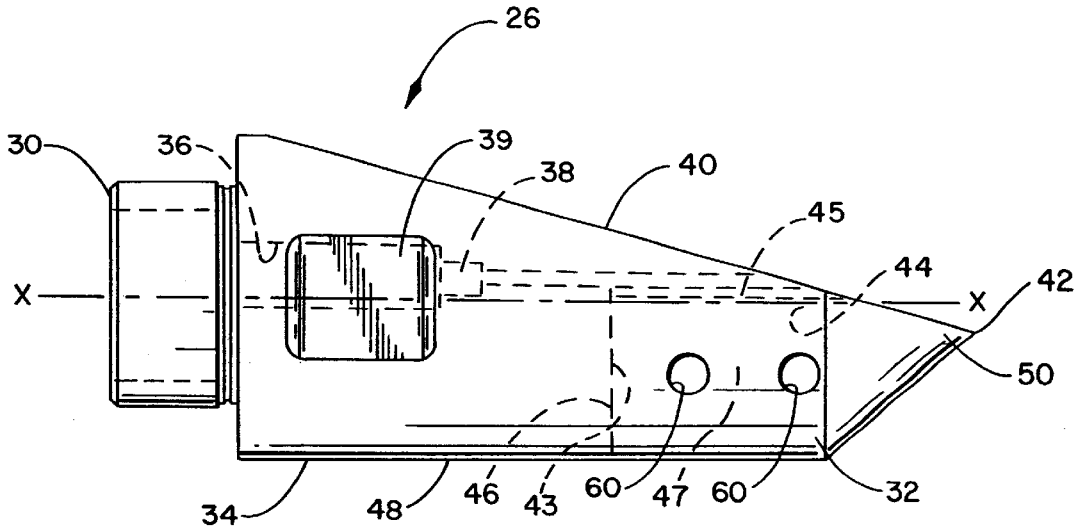
FIG. 4 is a side elevational view of the directional boring head shown in FIG. 2.

Referring now to FIGS. 3 and 4, the directional boring head 26 is shown. The directional boring head 26 is generally cylindrical with a rear end 30, a forward portion 32 and a body portion 34 therebetween. The rear end 30 of the directional boring head 26 is adapted to be releasably connectable to the end 20 of the drill string 16.

The directional boring head 26 may be provided with a fluid passage 36 continuous with a passage through the drill string. The fluid passage 36 of the directional boring head 26 preferably is parallel to longitudinal axis x—x of the directional boring head 26. Alternatively, a fluid passage may also be provided that is non-linear and/or non-parallel to the longitudinal x—x axis of the directional boring head.

The fluid passage may be used to permit drilling fluids to be passed from the boring machine, through the directional boring head assembly, and into the borehole. Drilling fluids may then be used to enhance the boring operation by cooling the directional boring head assembly and moistening the earth surrounding the boring apparatus. Typically, the moisture enables the directional boring head assembly to pack the soil against the walls of the borehole thereby assisting the directional boring head assembly in forming the borehole.

It may be desirable to include a check valve 38 to control the release of boring fluids from the directional boring head 26. The check valve 38 may also be used to block the back flow of contaminants into the directional boring head 26, particularly when drilling is not currently ongoing.

The directional boring head 26 may also be provided with gripping surfaces 39 preferably located on the body portion 34 of the directional boring head. The gripping surfaces 39 may be adapted to receive a tool, such as a pipe wrench, which may be used to rotate the directional boring head 26 for attachment to or removal from the end 20 of the drill string 16.

Referring still to FIGS. 3 and 4, the forward portion 32 of the directional boring head 26 defines a deflection surface 40 extending from the rear end 30 to the forward edge 42 of the directional boring head. As best seen in FIG. 4, the deflection surface 40 of the directional boring head 26 tapers downward from the rear end 30 and preferably terminates at the forward edge 42 of the directional boring head 26. That is, the deflection surface 40 is inclined at an angle relative to the longitudinal axis x—x of the directional boring head 26.

It should be noted that the deflection surface 40 is depicted as being substantially flat. However, it will be appreciated that the deflection surface 40 may be made convex or concave with a smooth, textured, or angled surface in accordance with the present invention. In other words, any configuration is sufficient which will deflect the directional boring head when the drill string is advanced in accordance with known procedures.

With continuing reference to FIGS. 3 and 4, the forward portion 32 of the directional boring head 26 is provided with a longitudinal slot 44. The longitudinal slot 44 preferably has a size and shape adapted to engagingly receive and support the cutting member 28, as will be more specifically described herein.

In the preferred embodiment, the longitudinal slot 44 forms a pocket 43 in the directional boring head 26. The pocket 43 is a three dimensional polygonal cavity having a top wall 45, a back wall 46 and two sidewalls 47. Preferably, the top wall 45, back wall 46 and two sidewalls 47 of the pocket 43 are closed and the front and bottom of the pocket 43 remain open to receive the cutting member 28. While the transverse slot is shown in FIGS. 3 and 4 as forming a pocket, it should be understood that the longitudinal slot may only have two side walls and a back wall.

The longitudinal slot 44 preferably extends a distance from the forward edge 42 toward the rear end 30 of the directional boring head 26, and a distance from the bottom 48 of the directional boring head 26 towards the fluid passage 36. As best seen in FIG. 3, the longitudinal slot 44 has a width and intersects a portion of the deflection surface 40, thereby dividing the forward edge 42 of the directional boring head 26 into two portions 50.

Figure 5:
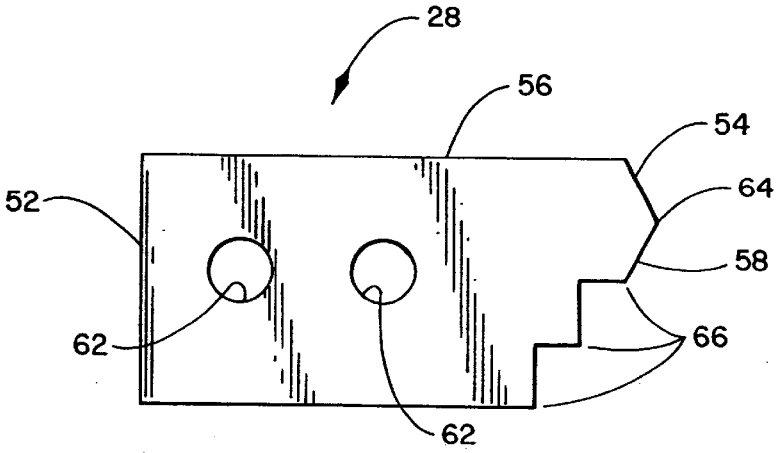
FIG. 5 is a side elevational view of the cutting member shown in FIG. 2.
Figure 3:
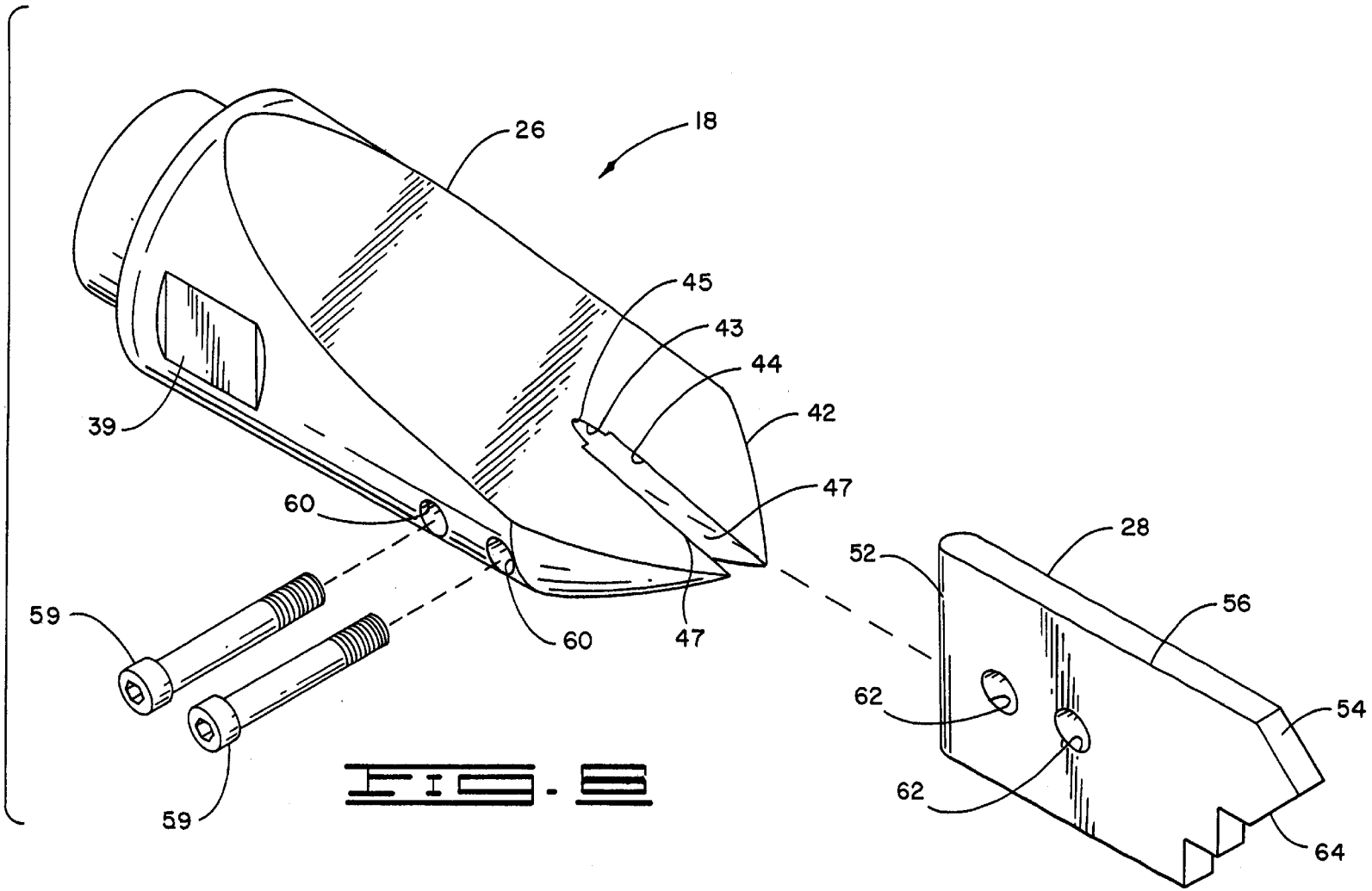

Referring now to FIG. 5, a preferred cutting member 28 is shown. The cutting member 28 is generally polygonal and has a planar rear portion 52, a forward end 54 and a body portion 56 therebetween. The forward end 54 of the cutting member 28 preferably is provided with a cutting edge 58 having a leading tooth 64 followed by a plurality of reclining steps 66. In the preferred embodiment, the cutting edge 58 is asymmetrical with the plurality of reclining steps 66 tapering from the leading tooth 64 back toward the planar rear portion 52 of the cutting member 28.

The cutting edge 58 may be provided with a variety of edge patterns to enhance the cutting and/or piercing action of the cutting member 28, including a serrated, smooth, or jagged edge. It should also be understood that the cutting edge 58 of the cutting member 28 is positionable relative to the forward edge 42 of the directional boring head 26. For example, at least a portion of the cutting edge 58 of the cutting member 28 may extend a distance beyond the forward edge 42 or be positioned behind the forward edge 42 of the directional boring head 26 and/or intersect at least a portion of the deflection surface 40 of the directional boring head .

The cutting member 28 may be provided with hard surface protection, such as an abrasion or wear resistant material, to increase the durability of the cutting member. The use of hard surface protection, such as tungsten carbide and weld beads, are described in U.S. Pat. No. 5,779,740, the entire contents of which are incorporated herein by reference. It should be understood that other materials for providing wear resistance for the cutting member may be used such as metallurgical case hardening or sintered diamond buttons.

Figure 7:
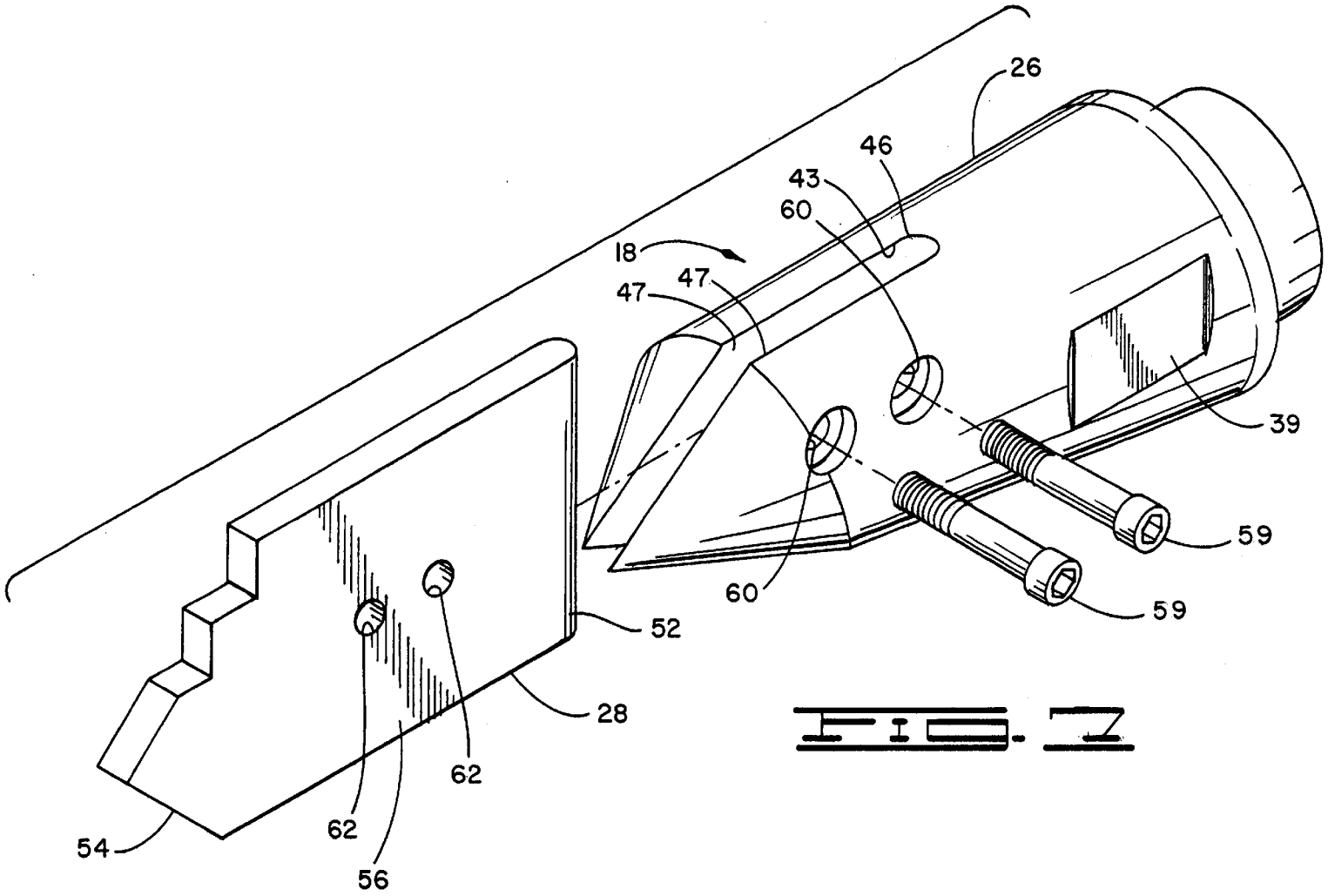
FIG. 7 is an inverted exploded, perspective view of the directional boring head assembly shown in FIG. 2.
Figure 5:
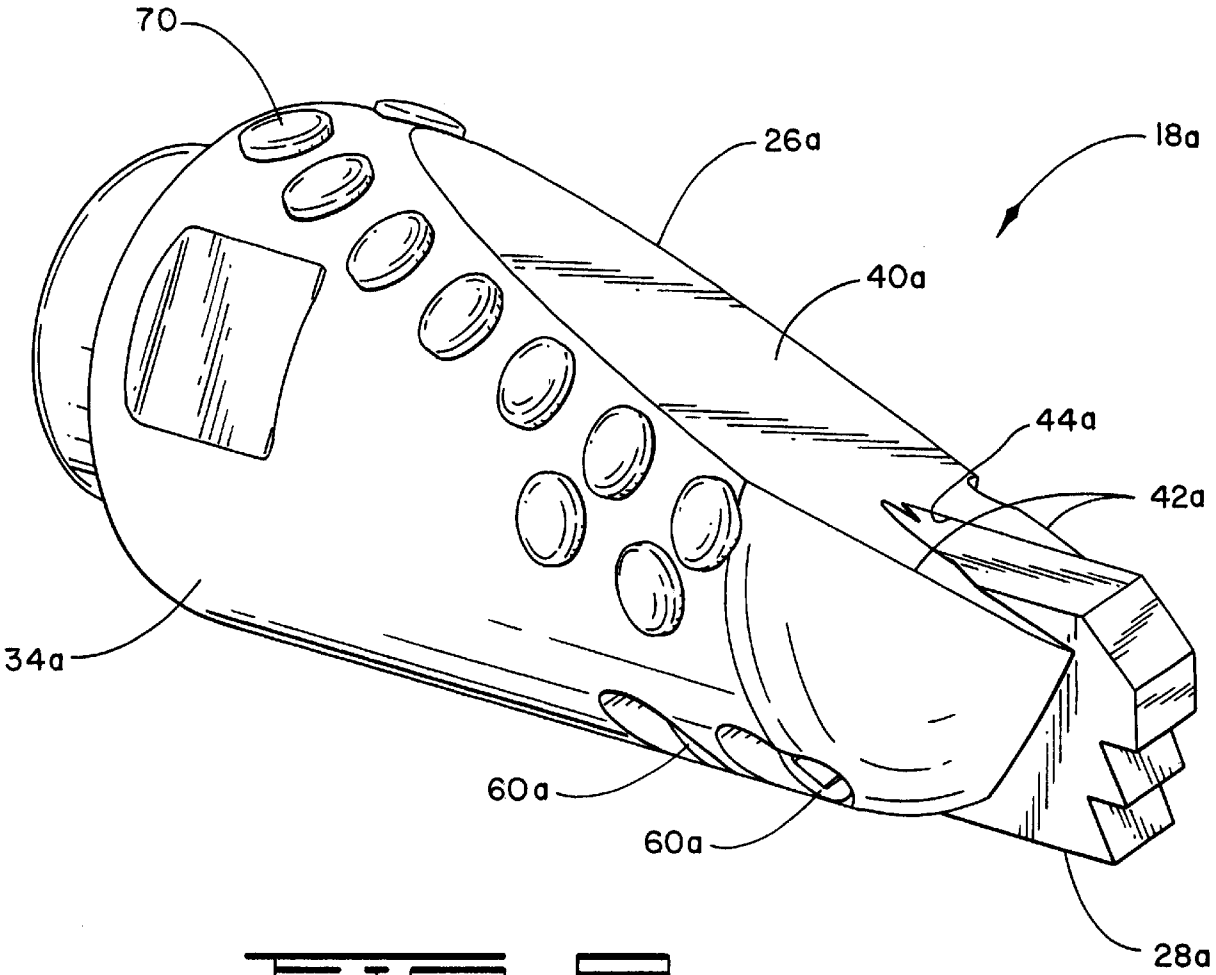

Referring now to FIGS. 2, 6 and 7, the placement of the cutting member 28 within the pocket 43 of the directional boring head 26 helps to secure the cutting member within the directional boring head. The cutting member 28 is sized and shaped to fit snugly in the pocket 43 and extend through the longitudinal slot 44.

The pocket 43 formed by the longitudinal slot 44 within the directional boring head 26 helps to retain the cutting member 28 within the directional boring head during operation. The planar rear portion 52 of the cutting member 28 is positionable against the top wall 45, back wall 46 and two sidewalls 47 of the pocket 43. The multi-surface support provided by the pocket 43 reduces the likelihood that the cutting member 28 will detach from the directional boring head 26 during operation. The pocket further enhances the boring operation by reducing the number of fasteners required to secure the cutting member within the directional boring head.

It should be further understood that while the pocket is shown as a three dimensional rectangular slot, the pocket may be provided with alternative geometries and cavities adapted to receive a cutting member with a corresponding configuration. For example, the cutting member may have portions extending from the rear end of the cutting member which are disposable within a pocket having corresponding cavities therein. These configurations may add to the gripping engagement between the cutting member and the directional boring head thereby further reducing the number of fasteners required to secure the cutting member within the directional boring head.

Preferably, the cutting member 28 is disposed within the longitudinal slot 44 so that the forward end 54 of the cutting member 28 is positioned near the forward edge 42 of the directional boring head 26. It is often desirable to have the forward end 54 of the cutting member 28 extend a distance beyond the forward portion 32 of the directional boring head 26 so that the cutting member 28 acts as the initial contact point with the borehole during the drilling operation. That is, the cutting member 28 can extend upwardly beyond the deflection surface 40, extend axially beyond the forward edge 42, or otherwise protrude outside of the pocket 43 in any direction above, below or in advance of the directional boring head 26.

Now it should be appreciated that, while a single longitudinal slot 44 is depicted with a single cutting member 28 therein, more than one cutting member may be inserted into a single longitudinal slot. Alternatively, more than one longitudinal slot 44 may be provided so that one or more cutting members 28 may be disposed in each longitudinal slot 44.

It should also be appreciated that while the shape of the cutting member is generally polygonal and planar, the cutting member may be of any shape that provides the directional boring head with cutting ability. The cutting member may be formed integrally with the directional boring head, or shaped to fit within the longitudinal slot and/or pocket. A variety of cutting blades may be interchanged and used with the directional boring head. Similarly, the longitudinal slot may be of any dimension and at any angle to house the cutting member in the desired orientation or location.

Referring now to FIGS. 6 and 7, the cutting member 28 may be releasably mounted to the directional boring head 26 by means of bolts 59. Preferably, the bolts 59 are insertable through holes 60 in the directional boring head 26 and holes 62 in the cutting member 28 and threadably connectable to the directional boring head 26. Alternatively, the bolts 59 may be disposed through the holes in the directional boring head and secured therein via means such as pins or nuts.

The holes 60 in the directional boring head 26 intersect the longitudinal slot 44 and preferably are aligned with the holes 62 in the cutting member 28 so that the cutting member 28 may be secured within the directional boring head 26 in the desired position. More than one bolt 59 may be used to secure the cutting member 28 in place thereby further establishing the desired position of the cutting member 28 within the directional boring head 26. When a connecting device such as a bolt threadably connected to the directional boring head is used, the bolt may be tightened so that the forward portions of the directional boring head are drawn together thereby clamping the cutting member therebetween.

It will be understood that various methods and devices for connecting the cutting member 28 to the directional boring head 26 may be employed including welds, glue, screws, pins, rivets, bonds, clamps, friction fit, set screws, pins, shims, adhesives, nuts and bolts, or welds. However, it will be appreciated that in some instances the cutting member 28 may be formed integrally with the directional boring head 26.

Referring now to FIGS. 2 and 8, the cutting member 28 is shown in a generally vertical orientation within the directional boring head 26. The cutting member 28 is positioned within the longitudinal slot 44 of the directional boring head 26 so that the cutting member bisects the forward portion 32 of the directional boring head 26 and forms two equal front portions 50.

As best seen in FIG. 2, the cutting member 28 extends a distance beyond the deflection surface 40 at an angle perpendicular to the deflection surface 40.

Figure 10:
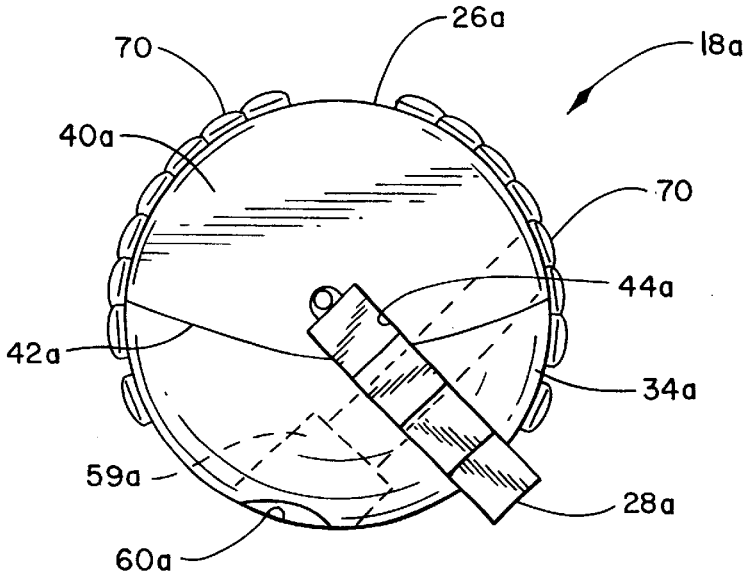
FIG. 10 is an end view of the directional boring head assembly of FIG. 9.

Turning now to FIGS. 9 and 10, a second embodiment of the directional boring head assembly 18*a* is shown. The directional boring head assembly 18*a* comprises a directional boring head 26*a*, a cutting member 28*a*, and a plurality of carbide buttons 70.

The second embodiment of the directional boring head assembly 18*a* is similar to the first embodiment of the directional boring head assembly 18 heretofore described, except that the position of the cutting member 28*a* is rotated about the longitudinal axis x—x of the directional boring head 26*a* so that the cutting member 28*a* is no longer perpendicular to the deflection surface 40*a*, as best seen in FIG. 10. In other words, the cutting member 28*a* is rotated counterclockwise 45 degrees about the longitudinal axis x—x defined by the directional boring head 26 and positioned in the directional boring head 26 at an angle non-perpendicular to the deflection surface 40*a*.

The non-perpendicular angle of the cutting member 28*a* shifts the position that the directional boring head contacts the borehole during the boring operation so that a larger portion of the outer surface of the directional boring head contacts the borehole. The increase in the amount of surface area of the directional boring head that contacts the borehole diffuses the contact force over a larger portion of the directional boring head thereby increasing wear resistance.

The directional boring head 26*a* may be provided with means for providing wear resistance for the directional boring head 26*a*, such as plurality of carbide wear buttons 70. The carbide wear buttons 70 are disposed on the body portion 34*a* adjacent the deflection surface 40. The use of hard surface protection, such as carbide wear buttons, are described in U.S. Pat. No. 5,779,740, previously incorporated herein. It should be understood that other methods of providing wear resistance for the directional boring head may be used such as metallurgical case hardening or hard surface welding material.

Figure 11:
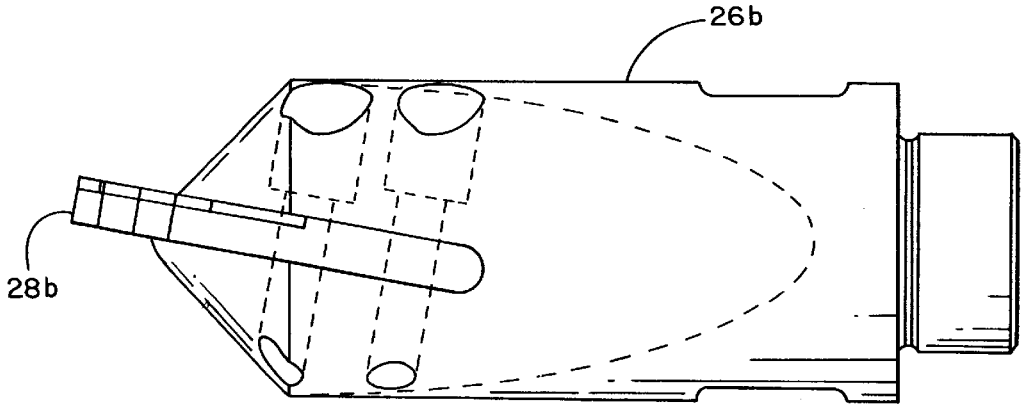
FIG. 11 is a top view of another embodiment of the directional boring head assembly of the present invention, and shows the cutting member in a position non-parallel to the linear axis of the directional boring head.

Referring now to FIG. 11, a third embodiment of the directional boring head assembly 18*b* is shown. The directional boring head assembly 18*b* comprises a directional boring head 26*b*, and a single planar cutting blade 28*b*.

The third embodiment of the directional boring head assembly 18*b* is similar to the first embodiment of the directional boring head assembly 18 heretofore described, except that the position of the single planar cutting blade 28*b* is non-parallel to the longitudinal axis x—x of the directional boring head 26*b*, as best seen in FIG. 11.

It should be noted that, the cutting member depicted in FIG. 11 is a single planar cutting blade 28*b*. However, it will be appreciated that a multi-blade cutting member may also be used with the present invention.

Now it will be appreciated that the present invention provides an improved directional boring head assembly. A boring head using the "slant face" directional technology is advantageously combined with a replaceable cutting member. The directional boring head assembly enhances the advantages of a releasable cutting member by permitting substitution of different cutting members for various types of soil. The flexibility of cutting members is particularly necessary where more than one type of soil is encountered. The advantages of the releasable cutting member may be combined with the advantages of the deflection surface of the directional boring head which provides directional control. The position of the cutting member may be placed at an angle to the deflection surface thereby preserving the directional capabilities of the deflection surface while enhancing the cutting and drilling capabilities of the cutting member. Together, the directional control of the directional boring head combined with the drilling action provided by the cutting member enhance the borehole operation.

Changes may be made in the combination and arrangements of the various parts, elements, steps and procedures described herein without departing from the spirit and scope of the invention as defined in the following claims.

What is claimed is:

1. A directional boring head assembly for use with a boring machine capable of directionally drilling boreholes in underground earth, wherein the boring machine includes a drill string with an end for supporting the directional boring head assembly, the directional boring head assembly comprising:

a directional boring head comprising a body, the body comprising a rear end and a forward portion, the rear end connectable to the end of the drill string and the forward portion comprising a slot;

a cutting member having a planar rear portion, a forward end, and a body portion therebetween, the planar rear portion insertable into the slot of the directional boring head, the forward end comprising a cutting edge, and wherein the cutting member is removably connected to the directional boring head; and wherein the forward portion of the directional boring head defines a deflection surface engageable with the underground earth when the drill string is advanced without rotation to steer the drilling operation along a desired path, the deflection surface inclined at an angle relative to a longitudinal axis of the directional boring head, and wherein a portion of the cutting member extends beyond the forward portion of the directional boring head.

2. The directional boring head assembly of claim 1 wherein the directional boring head further comprises means for providing wear resistance for the directional boring head.

3. The directional boring head assembly of claim 1 further comprising a bolt disposable through the cutting member and a portion of the directional boring head, the bolt connectable to the directional boring head.

4. The directional boring head assembly of claim 1 wherein the directional boring head is provided with a passage therethrough for flow of fluid.

5. The directional boring head assembly of claim 1 wherein the forward end of the cutting member is provided with at least one tooth.

6. The directional boring head assembly of claim 1 wherein the forward end of the cutting member is provided with an abrasion resistant material.

7. The directional boring head assembly of claim 2 wherein the means for providing wear resistance for the directional boring head comprises a plurality of carbide wear buttons.

8. The directional boring head assembly of claim 1 wherein the forward end of the cutting member is asymmetrical.

9. The directional boring head assembly of claim 8 wherein the forward end of the cutting member is stepped and has a leading tooth.

10. The directional boring head assembly of claim 1 wherein the directional boring head has a front end opposite the rear end, the cutting member extending a distance beyond the front end of the directional boring head.

11. The directional boring head assembly of claim 10 wherein the body portion of the cutting member extends a distance beyond the deflection surface of the directional boring head.

12. The directional boring head assembly of claim 11 wherein the planar rear portion of the cutting member is disposed perpendicular to the deflection surface.

13. The directional boring head assembly of claim 11 wherein the planar rear portion of the cutting member is disposed non-perpendicular to the deflection surface of the directional boring head.

14. The directional boring head assembly of claim 1 wherein the body portion of the cutting member extends a distance beyond the deflection surface of the directional boring head.

15. The directional boring head assembly of claim 14 wherein the planar rear portion of the cutting member is disposed perpendicular to the deflection surface.

16. The directional boring head assembly of claim 14 wherein the planar rear portion of the cutting member is disposed non-perpendicular to the deflection surface of the directional boring head.

17. A directional boring head for use with a boring machine capable of directionally drilling boreholes in underground earth, wherein the boring machine includes a drill string with an end for supporting the directional boring head, the directional boring head comprising:

a body comprising a rear end and a forward portion, the rear end connectable to the end of the drill string and the forward portion having a slot adapted to receivingly engage a removable cutting member; and wherein the body comprises a deflection surface engageable with the underground earth when the drill string is advanced without rotation to steer the drilling operation along a desired path, the deflection surface inclined at an angle relative to a longitudinal axis of the directional boring head.

18. The directional boring head of claim 17 wherein the directional boring head further comprises means for providing wear resistance for the directional boring head.

19. The directional boring head of claim 18 wherein the means for providing wear resistance for the directional boring head comprises a plurality of carbide wear buttons.

20. The directional boring head of claim 17 wherein the directional boring head further comprises connecting means for connecting the cutting member to the body.

21. The directional boring head of claim 20 wherein the connecting means comprises a bolt disposable through the cutting member and a portion of the directional boring head, the bolt connectable to the directional boring head.

22. The directional boring head of claim 17 wherein the directional boring head is provided with a passage therethrough for flow of fluid.

23. A directional boring machine capable of directionally drilling boreholes in underground earth, comprising:

a drill string comprising a downhole end;

means for intermittently rotating and axially advancing the drill string; a directional boring head assembly connected to the downhole end of the drill string, the directional boring head assembly comprising;

a directional boring head comprising a body, the body comprising a rear end and a forward portion, the rear end connectable to the downhole end of the drill string and the forward portion comprising a slot;

a cutting member comprising a planar rear portion, a forward end, and a body portion therebetween, the planar rear portion insertable into the slot of the directional boring head, the forward end comprising a cutting edge, and wherein the cutting member is connectable to the directional boring head;

connecting means for connecting the cutting member to the directional boring head; and wherein the forward portion of the directional boring head defines a deflection surface engageable with the underground earth when the drill string is advanced without rotation to steer the drilling operation along a desired path, the deflection surface inclined at an angle relative to a longitudinal axis of the directional boring head, and wherein a portion the cutting member extends beyond the forward portion of the directional boring head.

24. The directional boring machine of claim 23 wherein the connecting means comprises a bolt disposable through the cutting member and a portion of the directional boring head, the bolt connectable to the directional boring head.

25. The directional boring machine of claim 23 wherein the directional boring head is provided with a passage therethrough for flow of fluid.

26. The directional boring machine of claim 23 wherein the forward end of the cutting member is provided with at least one tooth.

27. The directional boring machine of claim 23 wherein the forward end of the cutting member is provided with an abrasion resistant material.

28. The directional boring machine of claim 23 wherein the forward end of the cutting member is asymmetrical.

29. The directional boring machine of claim 23 wherein the forward end of the cutting member is stepped and has a leading tooth.

30. The directional boring machine of claim 23 wherein the forward end of the cutting member extends a distance beyond the forward portion of the directional boring head.

31. The directional boring machine of claim 30 wherein the cutting member extends a distance beyond the deflection surface of the directional boring head.

32. The directional boring machine of claim 31 wherein the planar rear portion of the cutting member is disposed perpendicular to the deflection surface.

33. The directional boring machine of claim 31 wherein the planar rear portion of the cutting member is disposed non-perpendicular to the deflection surface of the directional boring head.

34. The directional boring machine of claim 23 wherein the cutting member extends a distance beyond the deflection surface of the directional boring head.

35. The directional boring machine of claim 34 wherein the planar rear portion of the cutting member is perpendicular to the deflection surface.

36. The directional boring machine of claim 25 wherein the planar rear portion of the cutting member is disposed non-perpendicular to the deflection surface of the directional boring head.

37. The directional boring machine of claim 23 wherein the directional boring head further comprises means for providing wear resistance for the directional boring head.

38. The directional boring machine of claim 37 wherein the means for providing wear resistance for the directional boring head comprises a plurality of carbide wear buttons.

39. A directional boring head assembly for use with a boring machine capable of directionally drilling boreholes in underground earth, wherein the boring machine includes a drill string with an end for supporting the directional boring head assembly, the directional boring head assembly comprising:

a directional boring head comprising a body, the body comprising a rear end, a forward portion, and a forward edge adjacent the forward portion, the rear end of the directional boring head removably connectable to the end of the drill string, the forward portion of the directional boring head defining a deflection surface and a slot;

a substantially planar cutting blade receivingly supported in the slot; and wherein the deflection surface is engageable with the underground earth when the drill string is advanced without rotation to steer the drilling operation along a desired path, the deflection surface is inclined at an angle and terminates at the forward edge, and wherein the cutting blade is non-parallel to a longitudinal axis of the directional boring head.

40. The directional boring head assembly of claim 39 wherein the cutting blade is non-perpendicular to the deflection surface.

* * * * *

UNITED STATES PATENT AND TRADEMARK OFFICE

CERTIFICATE OF CORRECTION

PATENT NO. : 6,250,404 B1
DATED : June 26, 2001
INVENTOR(S) : Floyd R. Gunsaulis It is certified that error appears in the above-identified patent and that said Letters Patent is hereby corrected as shown below:

Column 3,
Line 15, delete "an" and substitute therefor -- a downhole --.
Line 16, delete "a" and substitute therefor -- the --.
Lines 20 and 22, after "assembly" insert -- 18 --.
Line 32, delete the second occurrence of "is" and substitute therefor -- has a --.
Line 33, delete "with" and substitute therefor -- body 34 having --.
Line 33, delete "," and substitute therefor -- and --.
Line 33, after "32" insert -- . --.
Line 33, delete "and".
Line 34, delete "a body portion 34 therebetween.".
Lines 36 and 64, before "end" insert -- downhole --.
Line 60, delete "portion".
Line 61, after "head" insert -- 26 --.

Column 4,
Line 2, after "head" insert -- 26 --.
Line 15, after "string" insert -- 16 --.
Line 21, after "28" insert -- (K 16.2) --.
Line 36, delete "the" and substitute therefor -- a --.

Column 5,
Lines 9, 23, 28, 29, 30, 33, 35, 52, 58, 61 and 66, after "member" insert -- 28 --.
Lines 10, 15, 24, 34, 36, 60, 62 and 64, after "head" insert -- 26 --.
Line 15, after "head" insert -- 26 --.
Line 17, delete "top".
Lines 21, 25, 26 and 31, after "pocket" insert -- 43 --.
Lines 53, 62 and 65, after "slot" insert -- 44 --.

Column 6,
Lines 8, 18 and 19, after "head" insert -- 26 --.
Line 8, after "nuts" insert -- (not shown) --.
Line 17, delete "a" and substitute therefor -- the --.
Lines 17 and 18, after "bolt" insert -- 59 --.
Lines 20 and 34, after "member" insert -- 28 --.
Lines 49 and 54, delete "x-x".
Lines 54 and 55, delete "26" and substitute therefor -- 26a --.
Lines 58, 60, 62 and 64, after "head" insert -- 26a --.

UNITED STATES PATENT AND TRADEMARK OFFICE

CERTIFICATE OF CORRECTION

PATENT NO. : 6,250,404 B1
DATED : June 26, 2001
INVENTOR(S) : Floyd R. Gunsaulis It is certified that error appears in the above-identified patent and that said Letters Patent is hereby corrected as shown below:

Column 7,
Line 3, delete "40" and substitute therefor -- 40a --.
Line 4, after "buttons" insert -- 70 --.
Line 7, after "head" insert -- 26a --.

Signed and Sealed this

Twenty-eighth Day of May, 2002

*Attest:*

*Attesting Officer*

JAMES E. ROGAN
*Director of the United States Patent and Trademark Office*